US011203212B2

(12) United States Patent
Propersi Sterbiati et al.

(10) Patent No.: US 11,203,212 B2
(45) Date of Patent: Dec. 21, 2021

(54) WIDE FORMAT STAGGERED SINGLE PASS PRINTING APPARATUS

(71) Applicant: Electronics for Imaging, Inc., Fremont, CA (US)

(72) Inventors: Ernesto Propersi Sterbiati, Grassobbio (IT); Marco Serafini, Bergamo (IT)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 16/713,560

(22) Filed: Dec. 13, 2019

(65) Prior Publication Data

US 2021/0178779 A1 Jun. 17, 2021

(51) Int. Cl.

| | |
|---|---|
| ***B41J 2/14*** | (2006.01) |
| ***B41J 11/00*** | (2006.01) |
| ***B41J 3/54*** | (2006.01) |

(52) U.S. Cl.

CPC ..... *B41J 3/543* (2013.01); *B41J 2/14* (2013.01); *B41J 11/001* (2013.01); *B41J 11/007* (2013.01); *B41J 2002/14419* (2013.01)

(58) Field of Classification Search

CPC ... B41J 2/543; B41J 2/14; B41J 11/001; B41J 11/007

See application file for complete search history.

(56) References Cited

U.S. PATENT DOCUMENTS

| | | | | |
|---|---|---|---|---|
| 6,318,840 | B1 * | 11/2001 | Sette | B41J 3/543 347/37 |
| 2007/0296757 | A1 | 12/2007 | Mills et al. | |
| 2009/0153884 | A1 | 6/2009 | Lange et al. | |
| 2009/0189950 | A1 | 7/2009 | Kojima | |
| 2010/0289852 | A1 | 11/2010 | Woolfe et al. | |
| 2014/0028748 | A1 | 1/2014 | Hudd et al. | |

* cited by examiner

*Primary Examiner* — Jason S Uhlenhake
(74) *Attorney, Agent, or Firm* — Perkins Coie LLP

(57) ABSTRACT

The disclosed embodiments relate to a wide format single pass printing apparatus. The printing apparatus can include multiple print housings configured to receive print beams with print heads configured to print onto a substrate. The print housings can be horizontally adjacent to one another relative to a horizontal plane. The print housings can also be oriented opposite to one another. The print beams can be inserted and/or removed from each print housing from opposing ends, allowing for greater ease of access to the print beams.

19 Claims, 7 Drawing Sheets

WIDE FORMAT STAGGERED SINGLE PASS PRINTING APPARATUS

TECHNICAL FIELD

The present embodiments relate to a printing apparatus. More particularly, the present embodiments relate to a wide format single pass printing apparatus.

BACKGROUND

Inkjet printing is a printing type that recreates a digital image by depositing droplets of ink onto a substrate, such as paper or plastic. Many contemporary inkjet printers utilize drop-on-demand (DOD) technology to force droplets of ink from a reservoir through a nozzle onto the substrate. Accordingly, the mounting and positioning of the reservoir and nozzle (among other components) is critical to accurately allow the depositing of ink in the desired position. Together, these components form a print head (also referred to as a "print head assembly" or "print beam").

In many instances, it may be desirable to widen the printing area so as to more efficiently perform inkjet printing tasks. As an example, a widened printing area can facilitate print heads to deposit ink onto a substrate in a single pass (also referred to as "single pass printing"). However, in many cases, a widened printing area may increase the difficulty in maintaining a level print height of the print head assembly.

The physical position is typically controlled by tight-tolerance machined components, an adjustment mechanism, or both. Moreover, even small errors can result in poor printing quality, particularly if multiple sources of error combine to negatively affect positioning of the droplets on the substrate.

In many cases, the print head assembly may need to be exposed to perform maintenance tasks, such as replace ink for the print head assembly. With wide format printing apparatuses, it may become increasingly difficult to expose the print head assembly.

SUMMARY

In many cases, the print head assembly may need to be exposed to perform maintenance tasks, such as replace ink for the print head assembly. With wide format printing apparatuses, it may become increasingly difficult to expose the print head assembly.

The disclosed embodiments include a wide format staggered single pass printing apparatus. The printing apparatus can include a first print housing and a second print housing disposed above a printing area. The first housing can be mounted within a printing area and configured to receive a first group of removable print beams. The first group of removable print beams may include a first set of print heads capable of printing onto a substrate within the printing area.

The second housing can be mounted within the printing area. The second housing can be horizontally adjacent to the first housing. The second housing can be oriented opposite of the first housing. The second housing can include a second group of removable print breams with a second set of print heads capable of printing onto the substrate within the printing area.

The disclosed embodiments may also include a method for operating a wide format printing apparatus. The method may include mounting a first housing onto a first end of the wide format printing apparatus that is within a printing area.

The method may also include engaging a first removable print beam to the first housing. The first removable print beam may include a first set of print heads configured to print onto a substrate within the printing area.

The method may also include mounting a second housing onto a second end of the wide format printing apparatus within the printing area such that the second housing is horizontally adjacent to and oriented opposite to the first housing. The method may also include engaging a second removable print beam to the second housing. The second removable print beam may include a second set of print heads configured to print onto the substrate within the printing area.

This Summary is provided to introduce a selection of concepts in a simplified form that is further described below in the Detailed Description. This Summary is not intended to identify key features or essential features of the claimed subject matter, not is it intended to be used to limit the scope of the claimed subject matter. Other aspects of the disclosed embodiments will be apparent from the accompanying Figures and Detailed Description.

BRIEF DESCRIPTION OF THE DRAWINGS

The techniques introduced here may be better understood by referring to the following Detailed Description in conjunction with the accompanying drawings, in which like reference numerals indicate identical or functionally similar elements.

DETAILED DESCRIPTION

Figure 1:
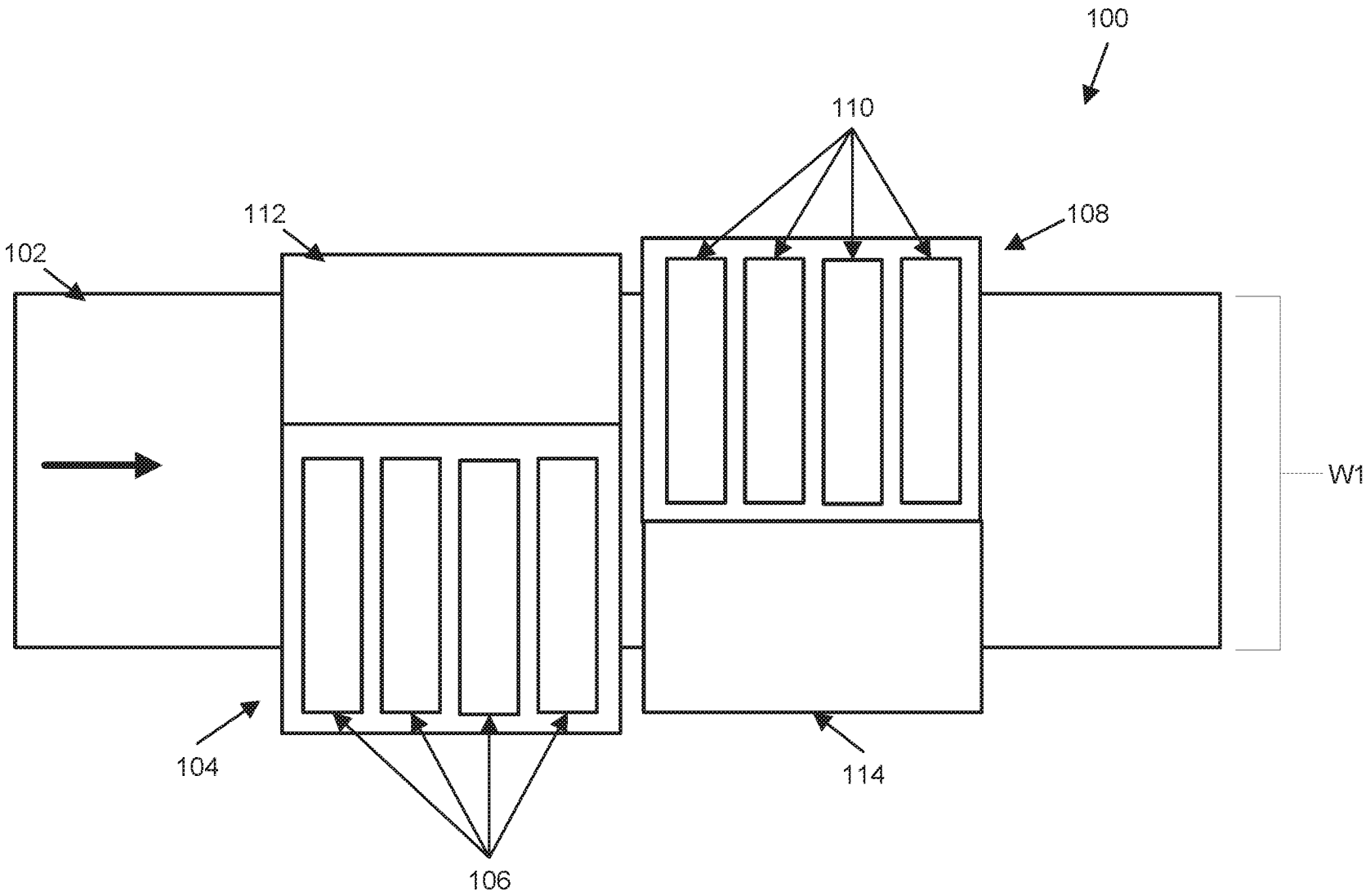
FIG. 1 illustrates a top view of an example wide format staggered single pass printing system.

Wide format printing systems may utilize several components, such as ink cartridge(s), belt, print beam(s), processor(s), controller(s), communications system(s), housing for the components, etc. These component(s) may collectively be referred to as the "printer components." For instance, a wide format printer designed to print onto a substrate (e.g., paper) may include a belt with a width sufficient to receive the substrate, a print beam with a width sufficient to print across the entire substrate, a processor controlling to the movement of the print beam, etc.

In many cases, printing systems including the components described above are common to households, office spaces, industrial businesses, etc. However, delivering high-quality printed materials on a large scale is not common. This is due to the sheer size of the machinery, the maintenance, the material, and space required. For example, one challenge is to generate high-quality wide format print material with congruent ink distribution. To do so, the immense weight of the components above the substrate can cause deformation of the components. In other words, some print beams cannot be closer to the substrate than other print beams. Another challenge, for example, is that printer components, such as print beams, require routine maintenance. Again, the sheer size of the components makes it difficult to perform such maintenance.

The present embodiments relate to a wide format single pass printing apparatus with two housings that are adjacent and opposite (or "staggered") to one another. As discussed in greater detail below, the wide format single pass printing apparatus as described herein may reduce an overall weight of printing components along the wide format printing area. This may result in maintaining level printing components on each staggered housing of the wide format single pass printing apparatus.

Further, the structure of the wide format single pass printing apparatus as described herein may allow for even distribution ink across a substrate in the printing area. Moreover, by incorporating multiple staggered housings, components from non-wide format printers can be used, rather than requiring printing components with custom, large-scale components.

Additionally, the staggered housings can be oriented in opposite directions in relation to one another. This orientation may allow for the print beams within each housing to print on separate portions of the substrate. Further, the print beams in a first housing can be inserted from one side of the substrate and the other set of print beams in a second housing can be inserted from an opposite side of the substrate. Accordingly, the print beams can be accessed from opposing edges of the substrate, thereby increasing efficiency in access to the print beams.

The embodiments set forth below represent the necessary information to enable those skilled in the art to practice the embodiments and illustrate the best mode of practicing the embodiments. Upon reading the following description in light of the accompanying figures, those skilled in the art will understand the concepts of the disclosure and will recognize applications of these concepts that are not particularly addressed herein. It should be understood that these concepts and applications fall within the scope of the disclosure and the accompanying claims.

The purpose of the terminology used herein is only for describing embodiments and is not intended to limit the scope of the disclosure. Where context permits, words using the singular or plural form may also include the plural or singular form, respectively.

As used herein, unless specifically stated otherwise, terms such as "processing," "computing," "calculating," "determining," "displaying," "generating," or the like, refer to actions and processes of a computer or similar electronic computing device that manipulates and transforms data represented as physical (electronic) quantities within the computer's memory or registers into other data similarly represented as physical quantities within the computer's memory, registers, or other such storage medium, transmission, or display devices.

As used herein, terms such as "connected," "coupled," or the like, refer to any connection or coupling, either direct or indirect, between two or more elements. The coupling or connection between the elements can be physical, logical, or a combination thereof.

System Overview

FIG. 1 illustrates a top view of an example wide format staggered single pass printing system 100. As shown in FIG. 1, printing system 100 can include a belt 102 that facilitates movements of a printing substrate across a printing area.

The belt 102 can be coupled to a moving mechanism such as conveyor belt, pulley system, etc. In some embodiments, belt 102 can be stationary; allowing a user to place the substrate onto the belt 102 within a printing area. Belt 102 can include a flat surface to rest the substrate below the first housing 104 and second housing 108. In some embodiments, the belt 102 can have gripping mechanism(s) along the edges of the belt 102 to hold the substrate in position during the printing process. For example, clamps, vises, fasteners, brackets, or another similar fastener can be placed along the belt 102 at varying distances.

In another embodiment, the housings 104, 108 can be adjustable. This may allow for printing on substrates with varying dimensions. For example, printing on paper may only need a minimal distance between belt 102, a first set of print beams 106 and a second set of print beams 110. In another example, printing on glass may need a greater distance between the belt 102, first set of print beams 106, and second set of print beams 110. The belt 102 can be attached to a mechanical apparatus (e.g., hydraulic system, electrical system) to vary the height of the belt 102.

The printing system 100 may include a first housing 104. The first housing 104 can include a first set of print beams 106 and a first support structure 112. The first set of print beams 106 can house print heads that facilitate printing onto the substrate. The first support structure 112 can engage to the first housing 104 to maintain a position of the first housing 104. For example, the first support structure 112 can maintain the first housing 104 at a level position to facilitate accurate printing on a substrate. The first housing 104 can house one or more removable print beams 106.

First housing 104 can include a substantially rectangular or cubic shape. Moreover, first housing 104 can span the width of belt 102 W1. For example, if the belt has a width W1 of 11.8 feet, first housing 104 can span the entirety of the 11.8-foot width of the belt 102. The printing area can include a length of at least 6 feet.

The first housing 104 can be engaged to the first support structure 112. The first support structure 112 can hold the first housing 104 in place above the belt 102. The first support structure 112 can engage with first housing 104 using a fastener, such as a clasp, hinge, bracket, etc. Conversely, first support structure 112 can be affixed to first housing 104 using a technique such as welding, for example.

Furthermore, the first support structure 112 can include a closed end on the first housing 104. As shown in FIG. 1, the closed end can prevent the first set of print beams 106 from being inserted or removed from that end. Conversely, on the opposite end, there can be an opening for the first set of print beams 106 to be inserted and extracted so as to access the printing apparatus.

The printing system 100 may include second housing 108. Second housing 108 may be positioned horizontally adjacent to the first housing 104. Further, second housing 108 may be oriented opposite to that of the first housing 104. The second support structure 114 can engage to the second housing 108 to maintain a position of the second housing 108. For example, the second support structure 114 can maintain the second housing 108 at a level position to facilitate accurate printing on a substrate.

Second housing 108 can include dimensions and features substantially similar to that of first housing 104. Second housing 108 can be placed adjacent to first housing 104 and oriented in the opposite direction of first housing 104, as shown in FIG. 1. The distance between the first housing 104 and the second housing 108 can be variable.

Additionally, the second housing 108 can be oriented opposite to the first housing 104. In other words, the print beams within each housing and the housings can face in opposite directions. Thereby, the entire width of belt 102 can be printed on by the combination of both sets of print beams. For example, as shown in FIG. 1, first set of print beams 106 are pointing downward and the second set of print beams 110 are pointing upward. Moreover, one set of print beams do not span the entirety of belt 102. The combination of both the first set of print beams 106 and second set of print beams 110 may cover the entire width of belt 102.

Generally, second support structure 114 can function similarly to the first support structure 112. For example, it can, among other things, form a closed end and an open end, support the weight of the print beams, and permanently or temporarily affix the second housing 108 to belt 102.

Figure 2:
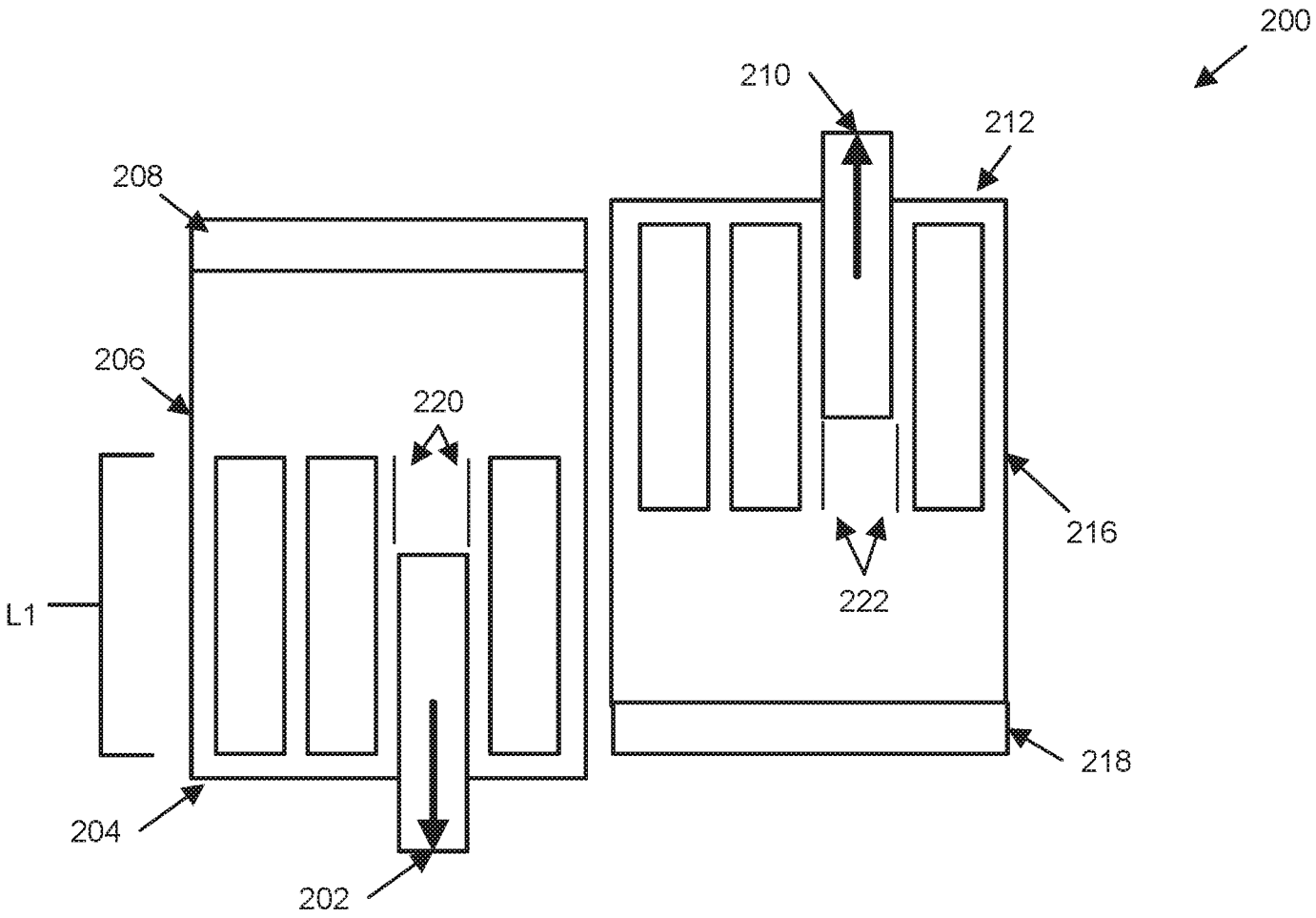
FIG. 2 is a top view illustration of an example set of print housings included in a printing apparatus.

FIG. 2 is a top view illustration of an example set of print housings included in a printing apparatus 200. As shown in FIG. 2, the first housing 206 can be horizontally adjacent to and have an orientation opposite to that of the second housing 216. In other words, the first housing 206 can be staggered in relation to the second housing 216.

The first housing 206 can include a first housing open end 204 and a first housing closed end 208. The first housing open end 204 can be open or exposed so as to allow print beams (e.g., print beam 202) inserted into the first housing open end 204. In some embodiments, print beams can be extracted to allow access to print housing 206. With a print beam extracted, the print beam and housing can be accessed and/or a maintenance procedure can be performed on the print beam. The first housing open end 204 can have a closing mechanism such as a hinged door, sliding door, a curtain, etc. The first housing closed end 208 can be closed and be configured to engage to a support structure to maintain a level position of the first housing 206 above a printing area.

Similarly, the second housing 216 can include a second housing open end 212 and a second housing closed end 218. The second housing open end 212 can be open or exposed so as to allow print beams (e.g., print beam 210) to be removed/inserted from/to the second housing open end 212. The second housing closed end 218 can be closed and be configured to engage to a support structure to maintain a level position of the second housing 216 above the printing area. The apparatus 200 can allow for print beams to be removed from opposing ends of a printing area, allowing greater efficiency in accessing the print beams.

The removable print beams (e.g., print beams 202, 210) can allow for a maintenance procedure to be performed on the apparatus 200. For example, a maintenance procedure can include removing print beam 202 from first housing open end 204, inspecting the print beam 202, and reinserting the print beam 202 into the first housing open end 204. As shown in FIG. 2, the print beam 202, 210 can move along housings 206, 216 using a set of rails 220, 222. For example, a print beam 202 can engage to both rails in the set of rails 220 configured to guide the print beam 202 to an engaged position in the first housing 206.

A print beam (e.g., print beam 202) can include length L1. As described in greater detail below, length L1 can include a length of at least 3 feet, or in some cases, approximately 5.9 feet or half of the width of the belt or printing area.

Figure 3:
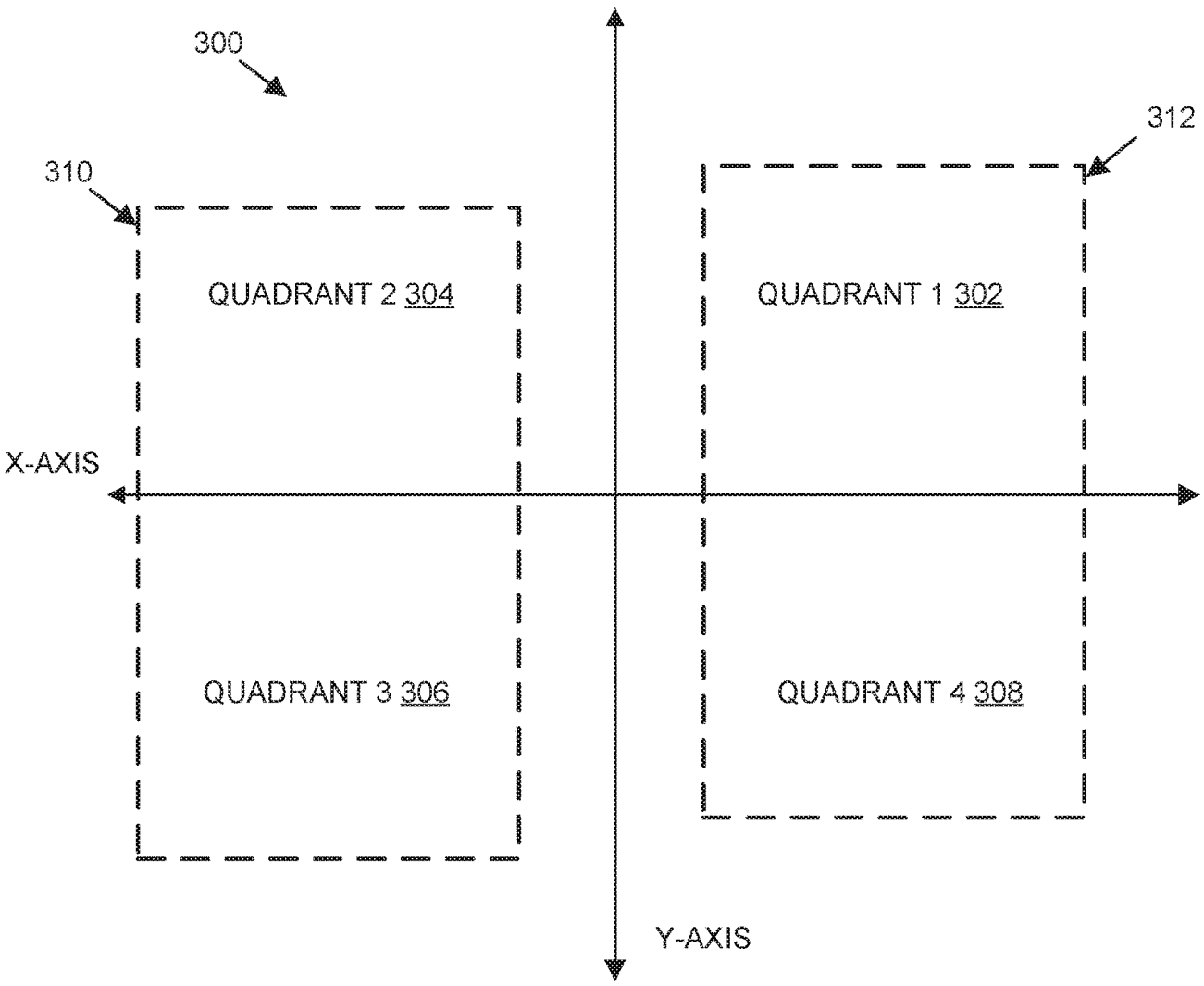
FIG. 3 is an example illustration of a cartesian plane indicative of a printing area.

FIG. 3 is an example illustration of a cartesian plane 300 indicative of a printing area. As noted above, the printing area is a region that allows for printing components to print onto a substrate. The printing area can include a 2-dimensional (e.g., a horizontal plane with an X-axis and Y-axis) plane below the staggered housings.

As shown in FIG. 3, the cartesian plane 300 can include multiple quadrants 302, 304, 306, 308. The quadrants 302, 304, 306, 308 can illustrate the configuration of the staggered housings in relation to the printing area. Generally, a set of print beams of each housing can face opposite to one another. For example, a first housing 310 can be disposed above quadrant 2 304 and quadrant 3 306. In this example, a second housing 312 can be disposed above quadrant 1 302 and quadrant 4.

Figure 4:
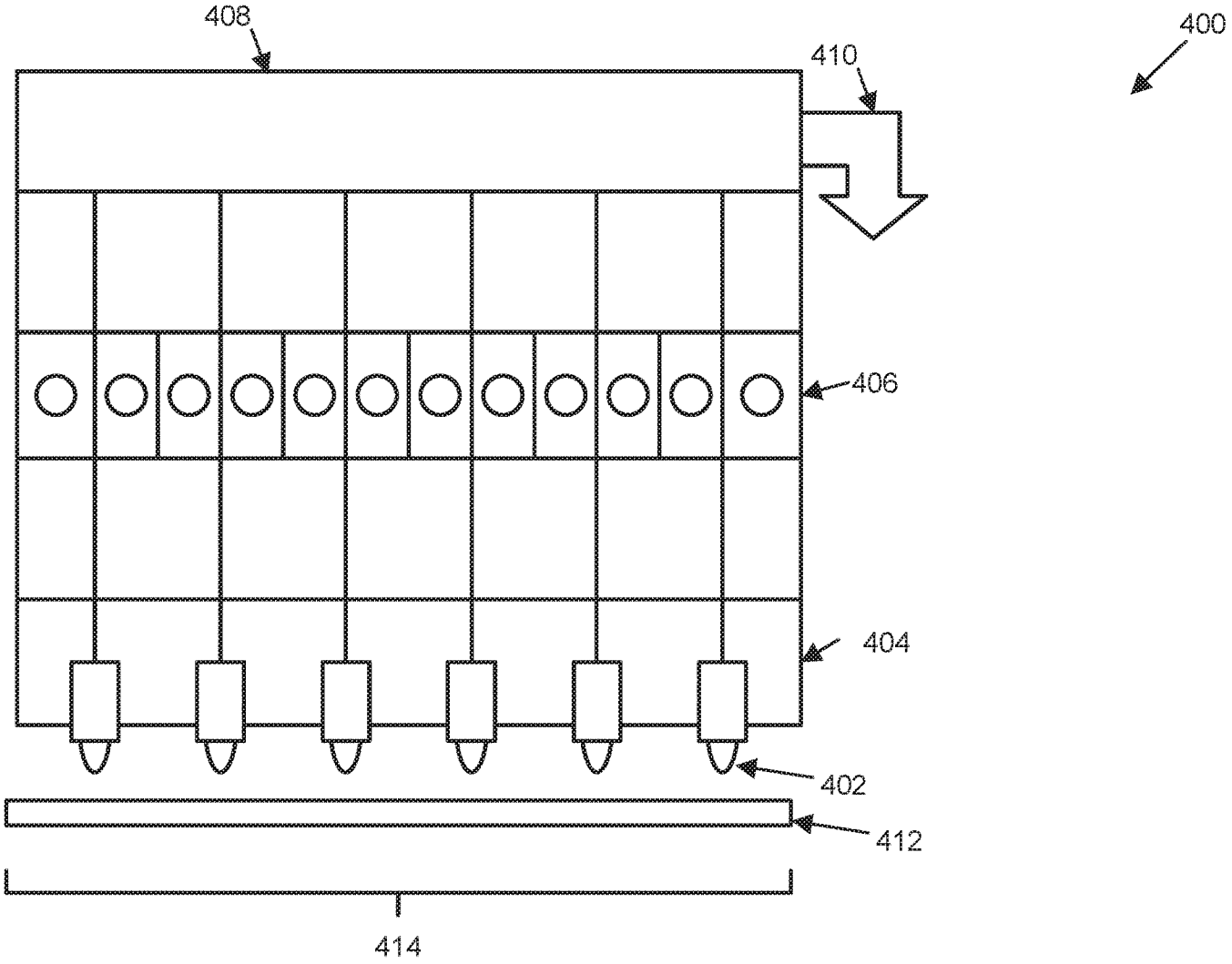
FIG. 4 is an illustration of an example individual print beam. Print beam can receive an indication to have print heads print onto substrate within printing area.

FIG. 4 is an illustration of an example individual print beam 400. Print beam 400 can receive an indication to have print heads 402 print onto substrate 412 within printing area 414. This indication can be received electronically via electronics 406. Print heads 402 can be held in place with high accuracy and aligned with each other by a print heads mount 404. Ink system 408 can provide a fluid (e.g., ink) to the print heads 402. Electrical cables and hydraulic tubing 410 can connect the print beam 400 to the printing apparatus as described herein. Accordingly, print beam 400 can receive instructions, communicate with other print beams, receive power, send maintenance alerts, send status alerts, etc.

As described above, print beam 400 can include dimensions allowing the print beam 400 to fit into a housing. Moreover, print beam 400 can include dimension that is approximately half the width (e.g., width W1) of the belt or printing area. For example, the printing area can be approximately 12 feet (or 11.8 feet) wide and print beam 400 can be approximately 6 feet (or 5.9 feet) long. Thus, using the two sets of print heads, as described above, can allow for simultaneous printing on different regions of a substrate.

Figure 5:
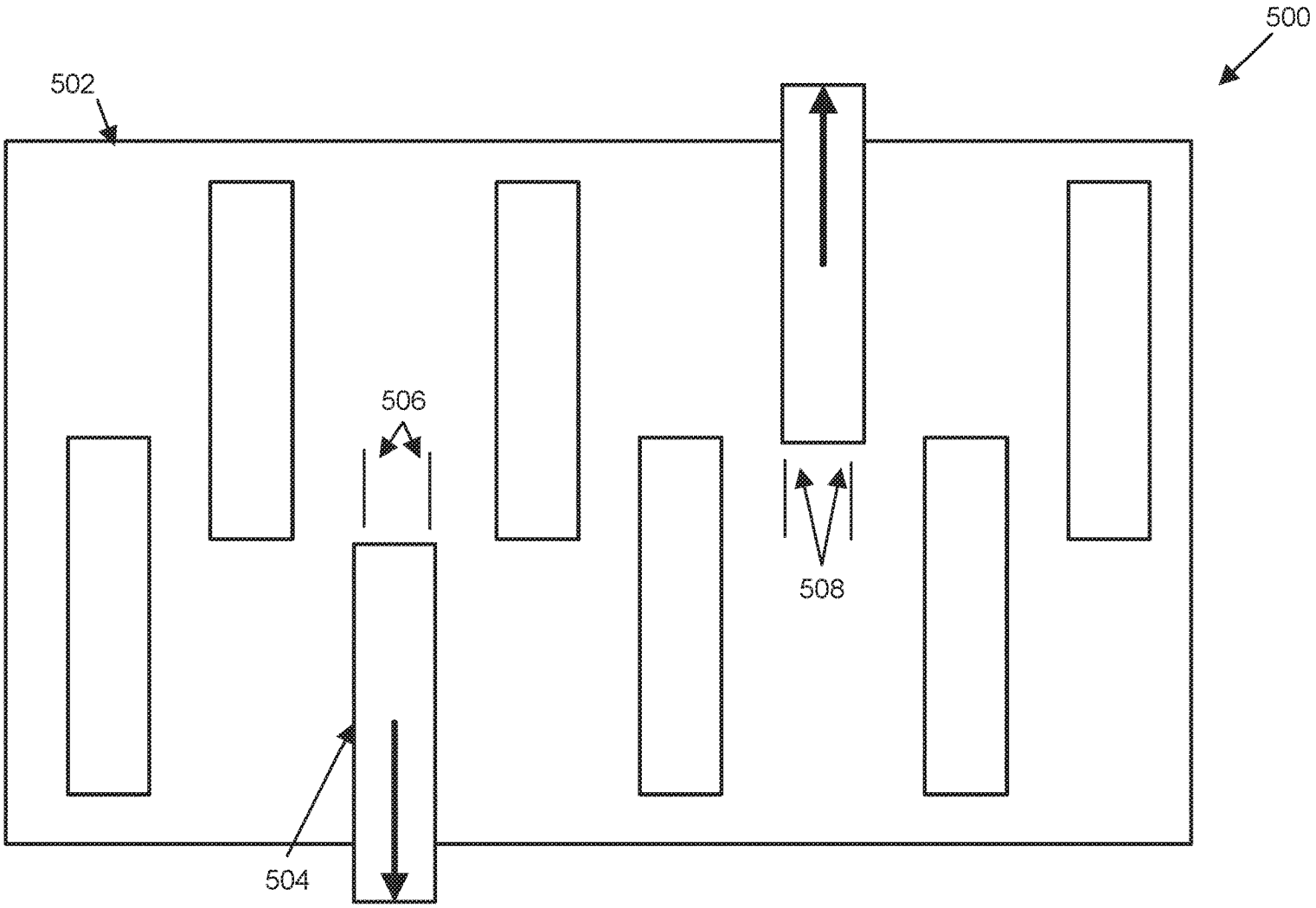
FIG. 5 is a top view of an example wide format single pass printing apparatus using a single housing with staggered print beams.

FIG. 5 is a top view of an example wide format single pass printing apparatus 500 using a single housing with staggered print beams. As shown in FIG. 5, the apparatus 500 can include a single housing 502.

The housing 502 can allow for multiple print beams (e.g., print beam 504) to be disposed throughout housing 502. The print beams can be staggered along the housing 502 such that print beams can be removed/inserted from/to the housing 502 from opposing ends. The housing 502 can include rails 506, 508 configured to guide movement of print heads to/from the housing 502.

Figure 6:
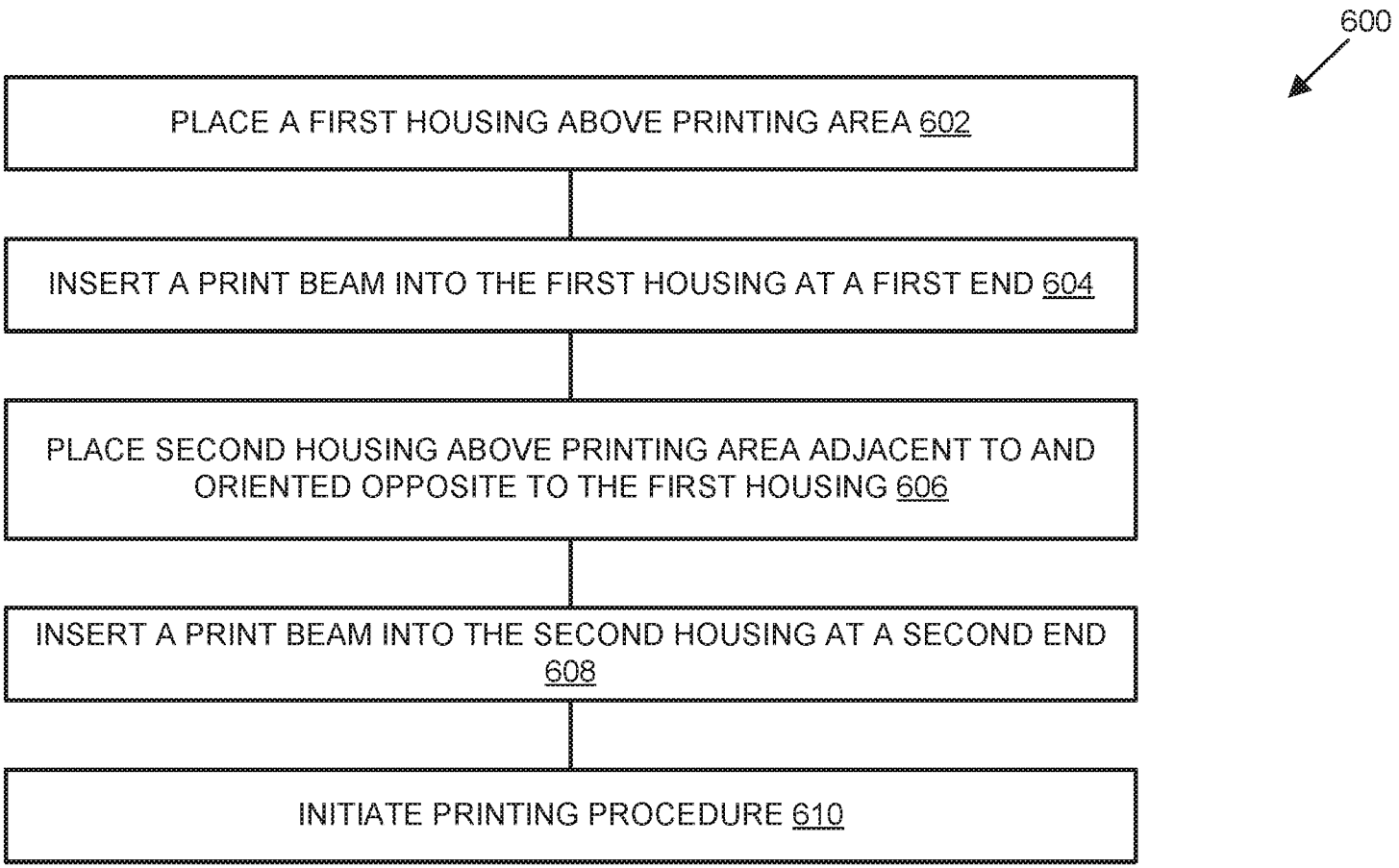
FIG. 6 is a block diagram of an example method for initiating a printing procedure using a wide format single pass printing apparatus.

FIG. 6 is a block diagram of an example method 600 for initiating a printing procedure using a wide format single pass printing apparatus. The method may include placing a first housing above a printing area (block 602). As detailed above, the first housing may be at a sufficient height above the printing area to allow print heads to print onto the substrate.

The method may include insert print beams into the first housing at a first end (block 604). The first housing can include one or more print beams, such as four print beams, for example. Each print beam can be configured to dispose a specific fluid (e.g., black ink, color ink) onto a substrate.

The method may include placing a second housing above a printing area adjacent to and oriented opposite to the first housing (block 606). The second housing can include an opposing orientation to that of the first housing and can be horizontally adjacent to the first housing along a horizontal plane.

The method can include inserting a print beam into the second housing at a second end (block 608). The second end can oppose the first end, allowing for efficient access to the print beams.

The method can include initiating a printing procedure (block 610). The printing procedure can include receiving an instruction to print onto a substrate and instructing print heads included in print beams to dispose a fluid onto the substrate in a specific pattern. The printing process can be single pass, meaning that the substrate is printing upon in a single pass along the print heads. The belt can move the substrate along the printing area past the print heads.

Figure 7:
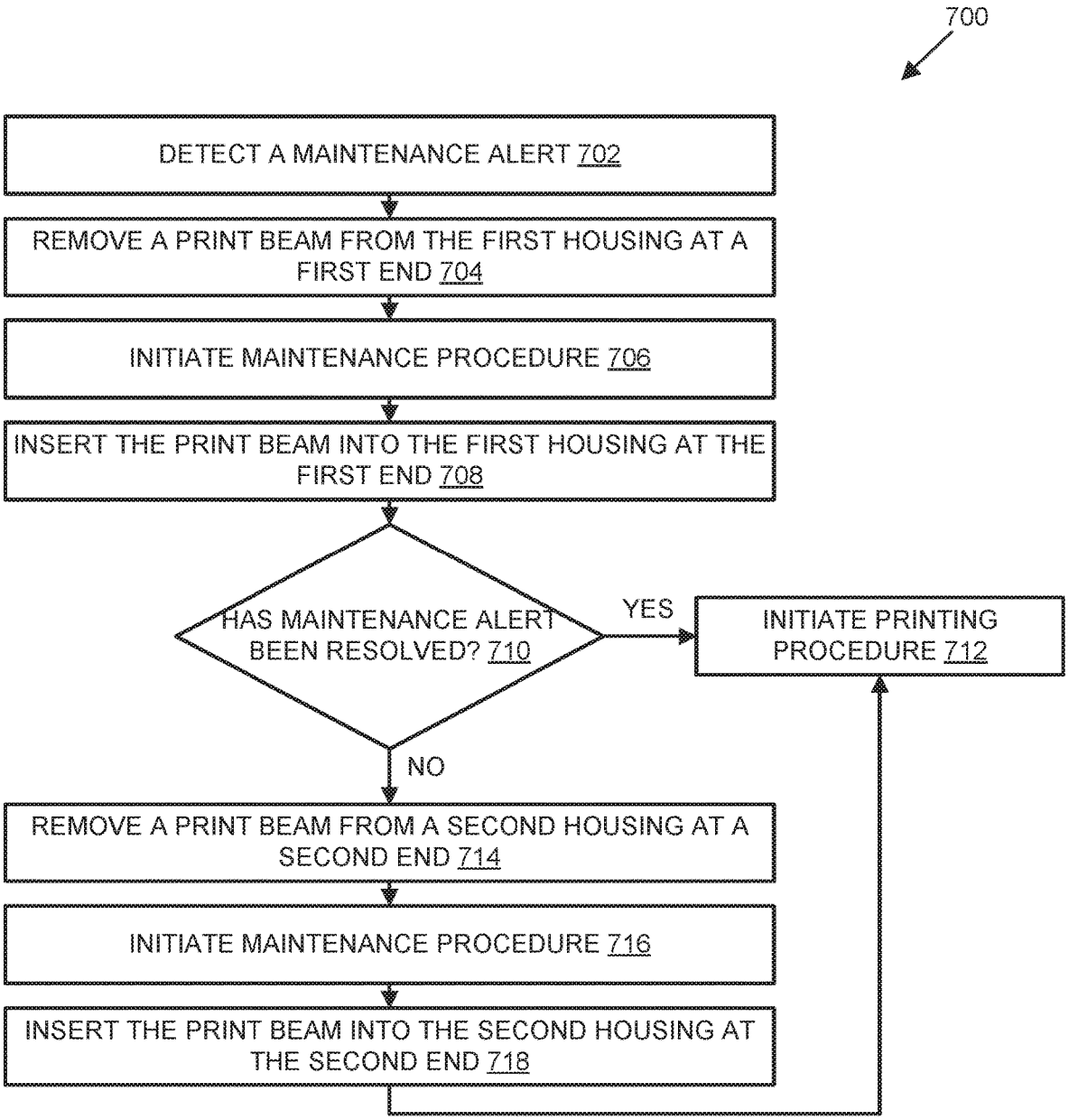
FIG. 7 is a flow diagram of an example maintenance process.

FIG. 7 is a flow diagram of an example maintenance process 700. As shown in FIG. 7, the process can include detecting a maintenance alert (block 702). A maintenance alert can include a trigger, signal, alarm, etc. that indicates that a maintenance procedure is to be initiated. For example, a maintenance procedure can include replacing or resetting a print beam or modifying an alignment of a print beam.

The process can include removing a print beam from the first housing at the first end (block 704). The print beam can be removed by guiding the print beam along rails from a print housing.

The process can include initiating a maintenance procedure (block 706). The maintenance procedure can be performed on a print beam and/or any other components included in the printing apparatus. This can include adjusting a component of the first housing or confirming an alignment of the printing components, for example.

The process can include inserting the print beam into the first housing at the first end (block 708). The process can include determining whether the maintenance alert has been resolved (decision block 710). If the maintenance alert has been resolved, a printing procedure can be initiated (block 712).

If the maintenance alert has not been resolved, the process can include removing a print beam form a second housing at a second end (block 714). The process can include initiating a maintenance procedure (block 716). The maintenance procedure can be performed on a print beam, for example. The process can include inserting the print beam into the second housing at the second end (block 718). Upon reinserting all print beams and/or determining that the maintenance alert has been resolved, the printing procedure can be initiated.

CONCLUSION

The above description and drawings are illustrative and are not to be construed as limiting. Numerous specific details are described to provide a thorough understanding of the disclosure. However, in certain instances, well-known details are not described in order to avoid obscuring the description. Further, various modifications may be made without deviating from the scope of the embodiments.

Reference herein to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Certain terms that are used to describe the disclosure are discussed above, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any term discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given above. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions will control.

From the foregoing, it will be appreciated that specific embodiments of the invention have been described herein for purposes of illustration, but that various modifications may be made without deviating from the scope of the invention. Accordingly, the invention is not limited except as by the appended claims.

What is claimed is:

1. A wide format printing system comprising:

a first housing mounted within a printing area and configured to receive a first group of removable print beams with a first set of print heads capable of printing onto a substrate within the printing area, wherein the first group of removable print beams are removable from a first side of the printing area; and a second housing mounted within the printing area, the second housing horizontally adjacent to, and oriented opposite of, the first housing, wherein the second housing includes a second group of removable print breams with a second set of print heads capable of printing onto the substrate within the printing area, and wherein the second group of removable print beams are removable from a second side of the printing area opposite the first side.

2. The wide format printing system of claim 1, wherein the printing area includes a width of at least 6 feet, wherein the first housing and the second housing are included in the printing area.

3. The wide format printing system of claim 1, wherein each removable print beam included in the first group of removable print beams and the second group of removable print beams includes a length of at least 3 feet.

4. The wide format printing system of claim 1, wherein each removable print beam included in the first group of removable print beams and the second group of removable print beams includes:

an ink system operable to provide ink to the print heads, each print head configured to emit ink on the substrate;

a communication system operable to transmit data to the print heads; and a print head mounting engaged to each print head and configured to align each print head with adjacent print heads.

5. The wide format printing system of claim 1, wherein each of the first set of print heads and the second set of print heads are configured to print onto the substrate on different regions of the printing area.

6. The wide format printing system of claim 1, further comprising:

a first support structure engaged to the first housing and configured to retain the first group of removable print beams above the printing area; and a second support structure engaged to the second housing and operable to retain the second group of removable print beams above the printing area.

7. The wide format printing system of claim 1, wherein the first housing is configured to receive four removable print beams included in the first group of removable print beams, and the second housing is configured to receive four removable print beams included in the second group of removable print beams.

8. The wide format printing system of claim 1, wherein the first housing is separate from the second housing, and wherein the first housing is configured to print on a first part of the printing area by the first set of print heads and the second housing is configured to simultaneously print on a second part of the printing area by the second set of print heads.

9. A wide format printer apparatus comprising:

a first housing oriented in a first direction and mounted within a printing area, the first housing configured to receive a first removable print beam at a first end of the printing area, wherein the first removable print beam is removable from the first end of the printing area; and a second housing adjacent to the first printing area and mounted within the printing area, the second housing configured to receive a second removable print beam from a second end of the printing area opposite the first end, wherein the second housing is oriented in a second direction opposite to that of the first direction and wherein the second removable print beam is removable from the second end of the printing area.

10. The apparatus of claim 9, wherein the first end includes a parallel orientation to that of the second end.

11. The apparatus of claim 9, further comprising:

a first set of rails disposed within the first housing and operable to guide the first group of removable print beams along the first housing; and a second set of rails disposed within the second housing and operable to guide the second of removable print beams along the second housing.

12. The apparatus of claim 9, wherein the printing area is substantially rectangular and includes a width of approximately 11.8 feet.

13. The apparatus of claim 9, further comprising:

a first support structure engaged to the first housing and configured to retain the first housing above the printing area; and a second support structure engaged to the second housing and operable to retain the second housing above the printing area.

14. The apparatus of claim 9, further comprising:

a belt configured to move the substrate along the printing area.

15. The apparatus of claim 9, wherein the first housing is horizontally adjacent to the second housing in relation to a horizontal axis.

16. A method for operating a wide format printing apparatus, the method comprising:

mounting a first housing onto a first end of the wide format printing apparatus that is within a printing area;

engaging a first removable print beam to the first housing via the first end of the wide format printing apparatus, the first removable print beam including a first set of print heads configured to print onto a substrate within the printing area;

mounting a second housing onto a second end of the wide format printing apparatus within the printing area, opposite the first end, such that the second housing is horizontally adjacent to and oriented opposite to the first housing; and engaging a second removable print beam to the second housing via the second end of the wide format printing apparatus, the second removable print beam including a second set of print heads configured to print onto the substrate within the printing area.

17. The method of claim 16, wherein said engaging the first removable print beam to the first housing further includes:

disposing the first removable print beam onto a first set of rails disposed within the first housing.

18. The method of claim 17, wherein the first set of rails are operable to guide the first print beam along the first housing.

19. The method of claim 16, further comprising:

removing the first removable print beam from the first end of the first housing; and removing the second removable print beam from the second end of the second housing.

* * * * *